US006295941B1

(12) United States Patent
Tajima

(10) Patent No.: US 6,295,941 B1
(45) Date of Patent: Oct. 2, 2001

(54) APPARATUS FOR FEEDING MATERIAL TO BE STITCHED IN A SEWING MACHINE

(75) Inventor: Ikuo Tajima, Kasugai (JP)

(73) Assignee: Tokai Kogyo Mishin Kabushiki Kaisha, Aichi (JP)

( * ) Notice: Subject to any disclaimer, the term of this patent is extended or adjusted under 35 U.S.C. 154(b) by 0 days.

(21) Appl. No.: 09/637,537

(22) Filed: Aug. 11, 2000

(30) Foreign Application Priority Data

Aug. 24, 1999 (JP) ..... 11-237445
Jan. 12, 2000 (JP) ..... 12-003902

(51) Int. Cl.[7] ..... D05B 21/00
(52) U.S. Cl. ..... 112/470.18
(58) Field of Search ..... 112/470.18, 470.06, 112/103, 470.14, 220, 102.5

(56) References Cited

U.S. PATENT DOCUMENTS 4,406,234 * 9/1983 Johnson et al. ..... 112/470.18
5,003,895 * 4/1991 Talanker ..... 112/103
5,553,565 * 9/1996 Ono et al. ..... 112/470.18

* cited by examiner

*Primary Examiner*—Peter Nerbun
(74) *Attorney, Agent, or Firm*—Koda & Androlia

(57) ABSTRACT

There is provided an apparatus for feeding accurately a material to be stitched in a sewing machine. The apparatus feeds a material to be stitched to desired positions within an X-Y rectangular coordinate plane on a machine table 1, the apparatus containing at least a pair of Y-direction drive mechanisms 10 arranged parallelwise to be spaced from each other; at lease a pair of X-direction drive mechanisms 11 also arranged parallelwise to be spaced from each other; a Y-direction driven body 36 connected to the Y-direction drive mechanisms to be driven on the machine table in the Y direction only; an X-direction driven body 30 connected to the X-direction drive mechanisms 11 to be driven on the machine table in the X direction only; and a frame body 37 for releasably holding the material to be stitched, the frame body 36 is connected in such a way as is movable in the X direction relative to the Y-direction driven body 36 and in the Y direction relative to the X-direction driven body 30; wherein the plurality of X-direction drive mechanisms 11 are designed to be disposed between a Y-direction drive mechanism 10 located at an outermost position and that located adjacent to it.

4 Claims, 4 Drawing Sheets

APPARATUS FOR FEEDING MATERIAL TO BE STITCHED IN A SEWING MACHINE

FIELD OF THE INVENTION

The present invention relates to an apparatus for feeding a material to be stitched to desired positions on a sewing machine table so as to apply to it stitches such as embroidery.

DESCRIPTION OF THE RELATED ART

Taking an embroidering machine, for example, there is known one which contains, as an apparatus for feeding a material to be stitched to desired positions within an X-Y rectangular coordinate plane of a machine table, an X-direction drive mechanism and a Y-direction drive mechanism disposed under the table and a rectangular frame body for holding the material to be stitched on the table. This frame body is connected to the X-direction drive mechanism and to the Y-direction drive mechanism so that the frame body is driven in the X direction and Y direction.

While the frame body holding the material to be stitched is driven in the X direction and Y direction as described above, it is not adapted to be guided securely by an X-direction guide member and a Y-direction guide member on the table, so that the frame body is likely to undergo strain when it is driven, unless it has substantial rigidity. Once the frame body is strained, the frame body and the material to be stitched held by it as a whole cannot be fed accurately, and stitched patterns are also strained depending on the location of machine heads in the embroidering machine, inconveniently.

Under such circumstances, a constitution for solving such inconvenience is proposed as disclosed, for example, in Japanese Unexamined Patent Publication (KOKAI) No. Hei 5-163660. According to this proposition, an X-direction guide member which is longer than the X-direction length of the frame body is disposed on the machine table and is connected directly to a Y-direction drive mechanism located under the table, and likewise a Y-direction guide member which is longer than the Y-direction length of the frame body is disposed on the machine table and is connected directly to an X-direction drive mechanism located under the table. The frame body according to this constitution is connected to the X-direction guide member and to the Y-direction guide member to be movable relative to them in the X direction and in the Y direction, respectively. Therefore, according to this constitution, the frame body is driven in the X direction and Y direction as desired under constant guiding by the X-direction guide member and Y-direction guide member, so that this constitution enjoys an advantage of preventing strain from occurring in the frame body.

However, in the above constitution, the X-direction guide member and the Y-direction guide member themselves can strain depending on the position of the frame body due to the arrangement relationship of the X-direction drive mechanism and the Y-direction drive mechanism located under the table. In such cases, the entire frame body is caused to be tilted even if the frame body itself is not strained, so that the material to be stitched held by the frame body cannot eventually be fed accurately in the X direction and Y direction, disadvantageously.

SUMMARY OF THE INVENTION

The present invention was accomplished in view of the problems involved in the prior art described above and is directed to providing an apparatus for feeding a material to be stitched in a sewing machine, which can feed the material accurately.

In order to overcome the problems described above and attain the intended objective, the present invention provides an apparatus for feeding a material to be stitched to desired positions within an X-Y rectangular coordinate plane on a sewing machine table. The apparatus contains a plurality of Y-direction drive mechanisms arranged parallelwise at predetermined intervals; a plurality of X-direction drive mechanisms also arranged parallelwise at predetermined intervals; a Y-direction driven body connected to the Y-direction drive mechanisms to be driven on the machine table in the Y direction only; an X-direction driven body connected to the X-direction drive mechanisms to be driven on the machine table in the X direction only; and a frame body for releasably holding the material to be stitched, which is connected to be movable in the X direction relative to the Y-direction driven body and in the Y direction relative to the X-direction driven body; wherein the plurality of X-direction drive mechanisms are designed to be disposed between a Y-direction drive mechanism located at an outermost position among the plurality of Y-direction drive mechanisms and that located adjacent to it.

Here "the X direction and the Y direction" may be taken either depthwise and crosswise respectively or vice versa with respect to the machine table.

DETAILED DESCRIPTION OF THE PREFERRED EMBODIMENT

Figure 1:
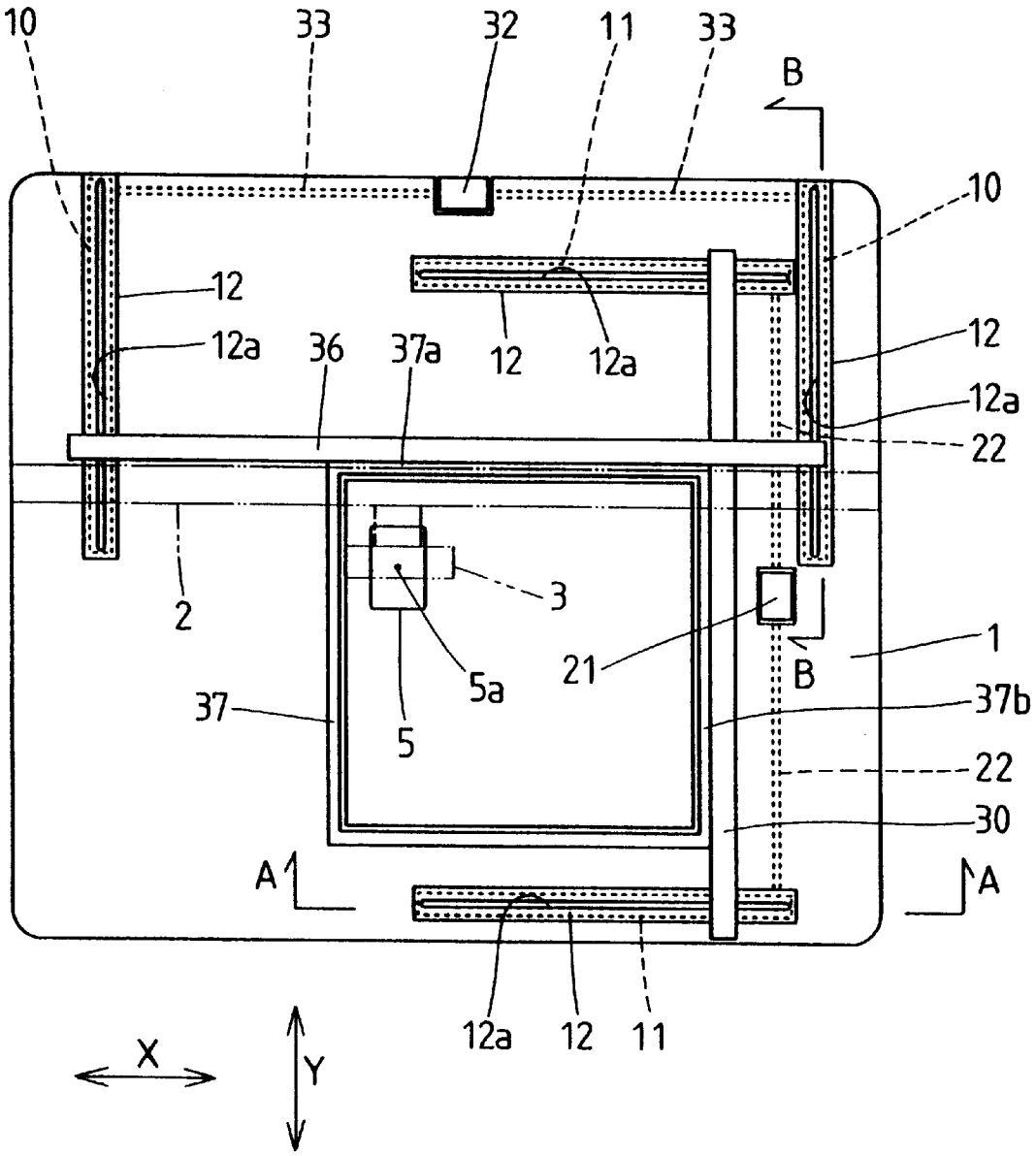
FIG. 1 is a plan view of an embroidering machine according to a preferred embodiment of the present invention.

Next, the apparatus for feeding a material to be stitched in a sewing machine according to the present invention will be described below by way of a preferred embodiment where the apparatus is applied to a single-head embroidering machine referring to the attached drawings. FIG. 1 is a plan view of the embroidering machine. A frame 2 is disposed parallelwise above a horizontal machine table 1. A machine head 3 is attached to the front of this frame 2. A shuttle base (not shown) supporting on it a shuttle, a thread cutter, etc. is located below the head 3 and is attached to the lower side of the table 1 to oppose the head 3. Here, the upper side of the shuttle base is covered with a needle plate 5 attached onto the table 1. The needle plate 5 contains a needle hole 5*a* permitting insertion of a needle to it.

The table 1 has on the lower side a pair of Y-direction drive mechanisms 10 arranged parallel to each other with a predetermined space secured between them in the X direction, as shown by the broken line in FIG. 1. The table 1 also has on the lower side a pair of X-direction drive mechanisms 11 arranged, between the pair of Y-direction drive mechanisms 10, parallel to each other with a predetermined space secured between them in the Y direction. That is, the pair of Y-direction drive mechanisms 10 and the pair of X-direction drive mechanisms 11 are attached to a lower frame 13 (see FIGS. 2 and 3) to sink in through holes defined in the table 1 and are covered at upper sides with covers 12, respectively.

Figure 2:
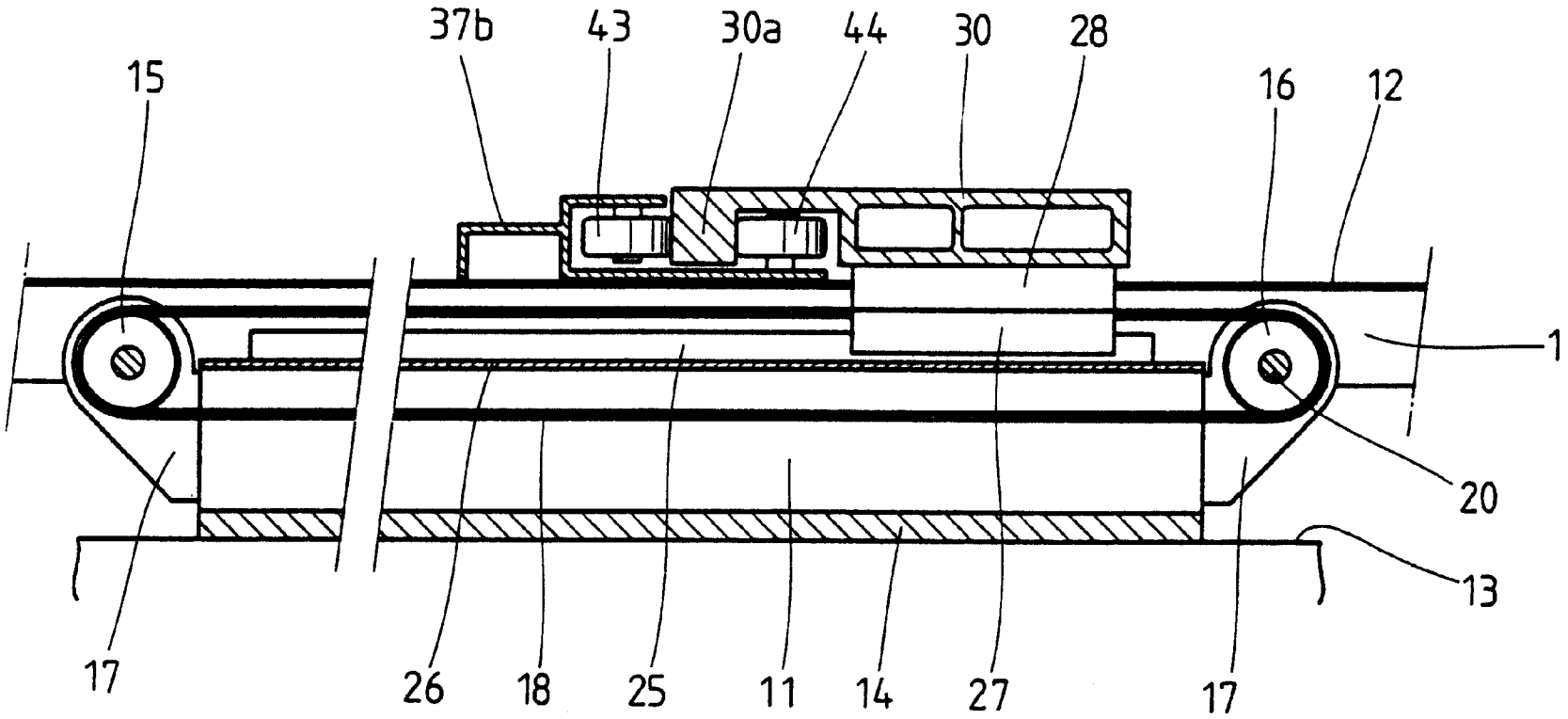
FIG. 2 is a cross-sectional view taken along the line A—A in FIG. 1.

Each X-direction drive mechanism 11 is essentially provided with timing pulleys 15 and 16 axially supported through brackets 17 at both ends of an open-top frame 14 having a U-shaped cross-section, respectively, and a timing belt 18 extended across these pulleys 15 and 16, as shown in FIG. 2. One pulley shaft 20 in one X-direction drive mechanism 11 is connected to the counterpart in the other X-direction drive mechanism 11 through a connecting shaft 22 of an X-axis drive motor 21, as shown in FIG. 1. Thus, when the X-axis drive motor 21 is driven in the normal direction or in the reverse direction, the pair of X-direction drive mechanism 11 are driven commonly through the connecting shaft 22, and the timing belts 18 are also driven to run in the same direction.

As shown in FIG. 2, a guide rail 25 is fixed on a support plate 26 located at the upper side of the frame 14 to extend in the X direction in each X-direction drive mechanism 11, and a slider 27 is fitted to this guide rail 25 to be able to run freely along it. An upper linear running portion of the timing belt 18 is clamped between the slider 27 and a spacer 28 superposed thereon to connect the spacer 28 to the timing belt 18. Meanwhile, the upper side of the spacer 28 in the X-direction drive mechanism 11 protrudes from the table 1 through a slit 12*a* formed in the cover 12 to extend in the X direction. An X-direction driven body 30 is extended across these opposing two spacers 28 and is fixed on the upper sides of them (see FIG. 1). Here, the X-direction driven body 30 has on the lower left-side end a rail 30*a* extended in the Y direction, as shown in FIG. 2.

Figure 3:
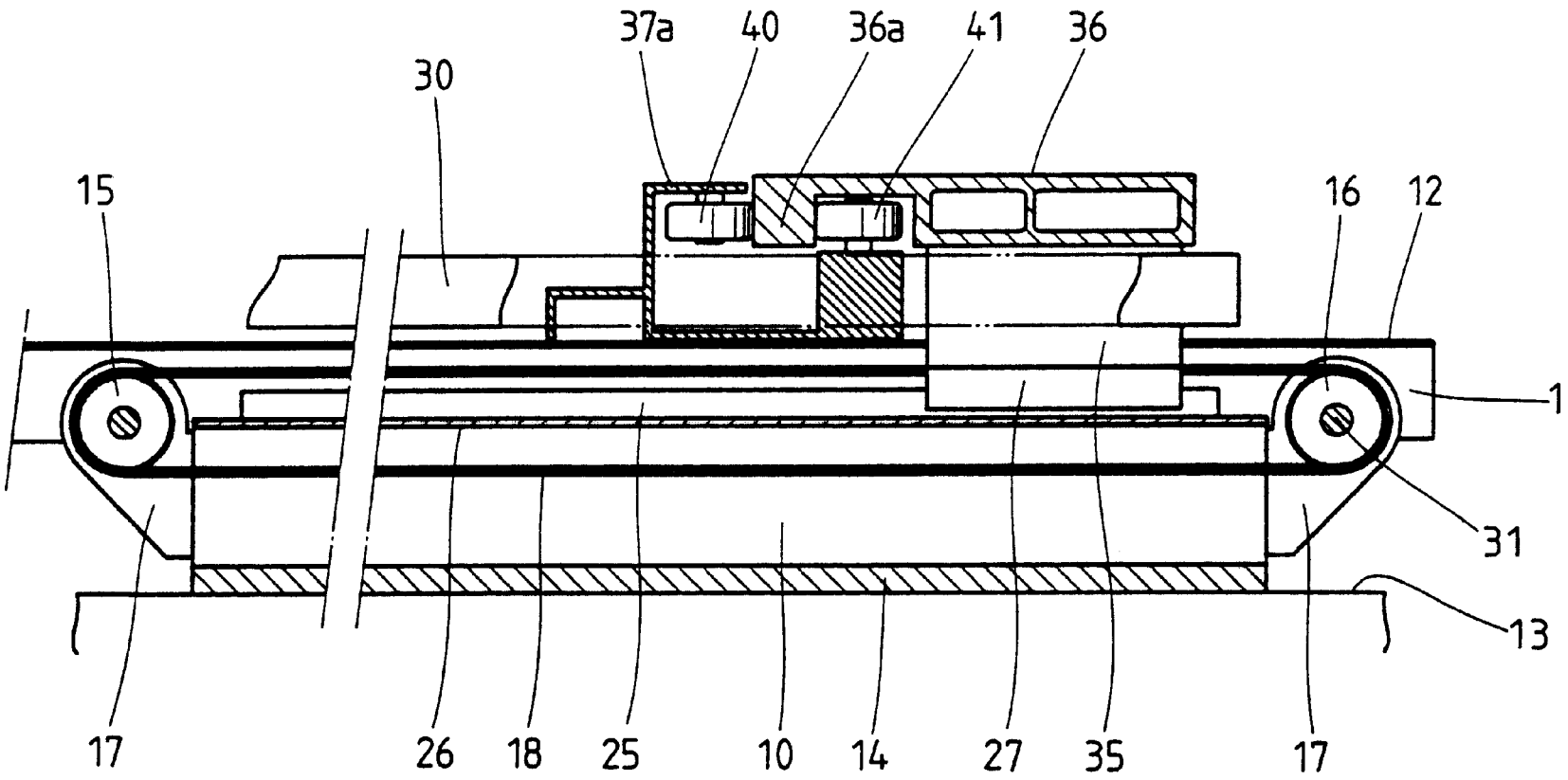
FIG. 3 is a cross-sectional view taken along the line B—B in FIG. 1.

Meanwhile, as shown in FIG. 3, each Y-direction drive mechanism 10 basically has substantially the same constitution as the X-direction drive mechanism 11. That is, opposing pulley shafts 31 in the Y-direction drive mechanisms 10 are connected to each other through a connecting shaft 33 of a Y-axis drive motor 32, as shown in FIG. 1. Thus, when the Y-axis drive motor 32 is driven in the normal direction or in the reverse direction, the pair of Y-direction drive mechanism 10 are driven commonly through the connecting shaft 33, and the timing belts 18 are also driven to run in the same direction. The upper side of a spacer 35 in the Y-direction drive mechanism 10 protrudes from the table 1 through a slit 12*a* formed in the cover 12 to extend in the Y direction, like in the X-direction drive mechanism 11 described above. A Y-direction driven body 36 is extended across these two spacers 35 and is fixed on the upper sides of them (see FIG. 1). Here, since the spacers 35 are designed to be taller than the spacers 28 in the X-direction drive mechanisms 11, the Y-direction driven body 36 is located upper than the X-direction driven body 30, as clearly shown in FIG. 3, so that they do not interfere with each other. The Y-direction driven body 36 has on the lower left-side end a rail 36*a* extended in the X direction, as shown in FIG. 3.

A frame body 37 for releasably holding a material to be stitched (not shown) is placed on the upper side of the table 1. More specifically, the frame body 37 has a rectangular shape. The frame body 37 is connected at the rear side edge 37*a* to the Y-direction driven body 36 and at the right side edge 37*b* to the X-direction driven body 30. Here, the frame body 37 is provided with some pairs of rollers (each pair consisting of an inner roller 40 and an outer roller 41) clamping the rail 36*a* of the Y-direction driven body 36 between them, as shown in FIG. 3. These pairs of rollers 40 and 41 permit movement of the frame body 37 in the X direction relative to the Y-direction driven body 36. Likewise, the frame body 37 is also provided with some pairs of rollers (each pair consisting of an inner roller 43 and an outer roller 44) clamping the rail 30*a* of the X-direction driven body 30 between them, as shown in FIG. 2. These pairs of rollers 43 and 44 permit movement of the frame body 37 in the Y direction relative to the X-direction driven body 30.

Next, operation of the apparatus for feeding a material to be stitched according to this embodiment will be described. When the X-axis drive motor 21 drives the X-direction drive mechanisms 11, the X-direction driven body 30 is driven in the X direction. Here, since the rear side edge 37*a* of the frame body 37 is adapted to be movable relative to the Y-direction driven body 36, the frame body 37 is fed in the X direction together with the X-direction driven body 30. Meanwhile, when the Y-axis drive motor 32 drives the Y-direction drive mechanisms 10, the Y-direction driven body 36 is driven in the Y direction. Here, since the right side edge 37*b* of the frame body 37 is adapted to be movable relative to the X-direction driven body 30, the frame body 37 is fed in the Y direction together with the Y-direction driven body 36.

Thus, when the X-axis drive motor 21 and the Y-axis drive motor 32 are driven based on embroidery data output from a control circuit (not shown), the X-direction drive mechanisms 11 and the Y-direction drive mechanisms 10 are also driven by them respectively, and the frame body 37 is moved as desired in the X direction and Y direction within the coordinate plane. This feeds the material to be stitched (not shown) held by the frame body 37 as desired in the X direction and Y direction on the table 1.

It should be noted here that since the pair of X-direction drive mechanisms 11 are located between the pair of Y-direction drive mechanisms 10, the X-direction driven body 30 and the Y-direction driven body 36 can be connected at around the end portions to the X-direction drive mechanisms 11 and to the Y-direction drive mechanisms 10 respectively. Therefore, even when the frame body 37 is located at any position in terms of the X direction and Y direction, the frame body 37 is adapted to receive drive forces from the X-direction driven body 30 and the Y-direction driven body 36 which are connected at both ends to the X-direction drive mechanisms 11 and to the Y-direction drive mechanisms 10, respectively. Thus, the frame body 37 can be moved without undergoing strain, and the material to be stitched held by the frame body 37 can be fed accurately irrespective of the position of the frame body 37. That is, embroidery can be applied to the material to be stitched accurately according to the embroidery data.

(Modification)

Figure 4:
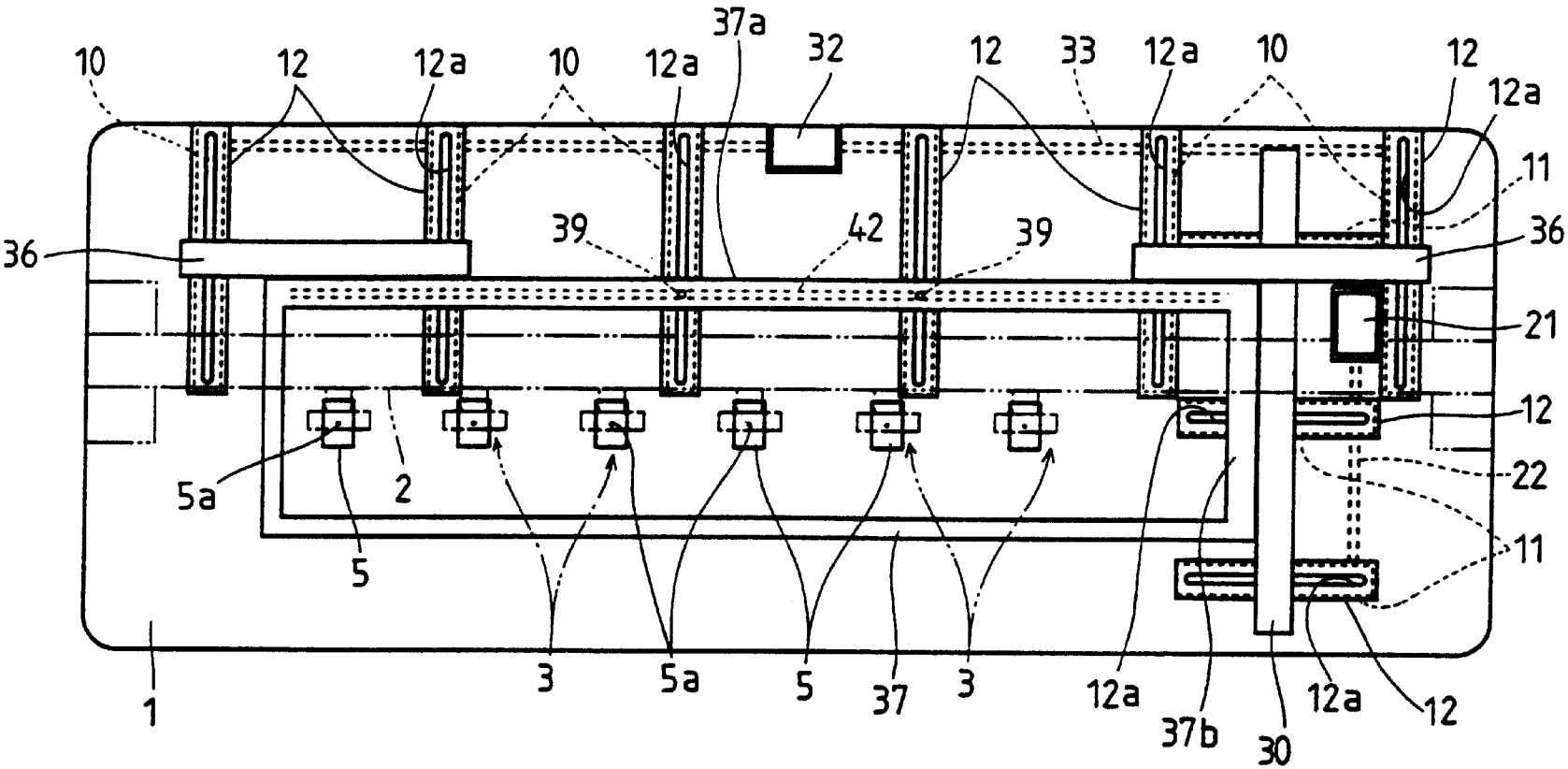
FIG. 4 is a plan view of a multi-head embroidering machine according to a modification of the present invention.

FIG. 4 shows a modification of the present invention applied to a multi-head embroidering machine having a plurality of machine heads. In this embodiment, those parts which have the same or equivalent functions as those in the foregoing embodiment are affixed with the same reference numbers respectively, and detailed descriptions of them will be omitted. FIG. 4 shows a plan view of the multi-head embroidering machine. A frame 2 is disposed horizontally above a horizontal machine table 1. A plurality of machine heads 3 (six heads in this embodiment) are attached to the front of this frame 2 at predetermined intervals. A shuttle base (not shown) is located below each head 3 and is attached to the lower side of the table 1 to oppose the head 3. Here, the upper side of each shuttle base is covered with a needle plate 5 attached onto the table 1. The needle plate 5 contains a needle hole 5*a* permitting insertion of a needle to it.

The table 1 has on the lower side a plurality of (six in this embodiment) Y-direction drive mechanisms 10 which are of the same constitution as those in the embodiment described referring to FIG. 1. The mechanisms 10 are arranged parallel to one another at predetermined intervals in the X direction and are connected to one another through a connecting shaft 33 of a Y-axis drive motor 32 so that the mechanisms 10 can be driven synchronously. A plurality of (three in this embodiment) X-direction drive mechanisms 11 of the same constitution as those in the above embodiment are arranged parallel to one another at predetermined intervals in the Y direction between the Y-direction drive mechanism 10 located at the rightmost position and that located adjacent to it and are connected to one another through a connecting shaft 22 of an X-axis drive motor 21 so that the mechanisms 11 can be driven synchronously.

An X-direction driven body 30 is disposed on all of the X-direction drive mechanism 11. This X-direction driven body 30 is fixed to each X-direction drive mechanism 11 through a spacer 28 (see FIG. 2) protruding through a slit 12*a* formed in a cover 12 of the mechanism 11 to extend in the X direction, like in the above embodiment. Meanwhile, a Y-direction driven body 36 is disposed on the Y-direction drive mechanism 10 located at the rightmost position and that located adjacent to it. This Y-direction driven body 36 is also fixed to these Y-direction drive mechanisms 10 through spacers 35 (see FIG. 3) protruding through slits 12*a* extended in the Y direction in the covers of the Y-direction drive mechanisms 10, respectively, like in the above embodiment. Further, another Y-direction driven body 36 is disposed on the Y-direction drive mechanism 10 located at the leftmost position and that located adjacent to it. This Y-direction driven body 36 is fixed to these Y-direction drive mechanism 10 through spacers 35 (see FIG. 3) protruding through slits 12*a* defined in covers 12 in the Y direction. These two Y-direction driven bodies 36 are arranged in alignment with each other. Here, there is no possibility of interference between the left Y-direction driven body 36 and the X-direction driven body 30, so that the former and the latter may be located at the same level.

A rectangular frame body 37 for securing a material to be stitched (not shown) is placed on the upper side of the table 1. The frame body 37 is connected at the rear side edge 37*a* to these two Y-direction driven bodies 36 and at the right side edge 37*b* to the X-direction driven body 30. Here, the connection of the rear side edge 37*a* of the frame body 37 to the Y-direction driven bodies 36 and the connection of the right side edge 37*b* of the frame body 37 to the X-direction driven body 30 are the same as in the above embodiment. Thus, the frame body 37 is connected to be movable in the X direction relative to the Y-direction driven bodies 36 and to be movable in the Y direction relative to the X-direction driven body 30.

In two Y-direction drive mechanisms 10 located at the center, each slider 27 supports a roller 39 in place of the spacer 35 (FIG. 4). The roller 39 can rotate on a vertical axis. That portion of the roller 39 which protrudes through the slit 12*a* from the upper side of the table 1 is engaged with a groove 42 defined in the X direction on the lower rear side edge 37*a* of the frame body 37. Incidentally, such a constitution is also possible as the second Y-direction drive mechanism 10 from the right and that from the left are provided with rollers 39 respectively, which are fitted in the groove 42.

Next, operation of this modification will be described. When the X-axis drive motor 21 drives the X-direction drive mechanisms 11, the X-direction driven body 30 is driven to move in the X direction. Here, since the rear side edge 37*a* of the frame body 37 is adapted to be movable relative to the Y-direction driven bodies 36, the frame body 37 is fed in the X direction together with the X-direction driven body 30. Meanwhile, when the Y-axis drive motor 32 drives the Y-direction drive mechanisms 10, the pair of Y-direction driven bodies 36 are driven to move in the Y direction, while the central two rollers 39 are driven to move in the Y direction. Thus, the frame body 37 is fed in the Y direction together with the Y-direction driven bodies 36, since the right side edge 37*a* of the frame body 37 is adapted to be movable relative to the X-direction driven body 30.

Thus, when the X-axis drive motor 21 and the Y-axis drive motor 32 are driven based on embroidery data, the X-direction drive mechanisms 11 and the Y-direction drive mechanisms 10 are also driven by them respectively, and the frame body 37 is driven to move in the X direction and Y direction. This feeds the material to be stitched (not shown) held by the frame body 37 in the X direction and Y direction on the table 1. Here, two corners of the rear side edge 37*a* in the frame body 37 do not disengage from the Y-direction driven bodies 36 respectively, even when the frame body 37 is fed to any position, and thus the frame body 37 is inevitably subject to a drive force of the Y-direction driven bodies 36 in the Y direction. Therefore, like in the foregoing embodiment, the frame body 37 is driven to move without undergoing strain, and the material to be stitched held by the frame body 37 can be fed accurately irrespective of the position of the frame body 37.

This modification exemplifies a case where a plurality of machine heads are installed, so that the frame body 37 is elongated in the X direction. In such cases, the Y-direction driven body is not extended over all of the Y-direction drive mechanisms 10 but is extended in parts over some of such mechanisms 10 located at both sides so as to achieve weight reduction. However, it is of course possible to employ an elongated Y-direction driven body 36. Further, the vertical positional relationship between the X-direction driven body 30 and the Y-direction driven bodies 36 so as to avoid interference between them may not particularly be limited. The same shall apply to the foregoing embodiment.

It should be noted here that:

(1) in the embodiment of the present invention, the drive sources for the X-direction drive mechanisms and the Y-direction drive mechanisms may be the conventional linear motors;

(2) in the embodiment of the present invention, while a plurality of X-direction drive mechanisms (a plurality of Y-direction drive mechanisms) are adapted to be driven commonly by a single motor, these mechanisms may be driven synchronously by different motors respectively;

(3) in the modification, the X-direction drive mechanisms and the Y-direction drive mechanisms may also be of constitutions employing linear motors respectively; and (4) in the modification, while the X-direction drive mechanisms (the Y-direction drive mechanisms) are adapted to be driven commonly by a single motor, these mechanisms may be driven synchronously by different motors respectively.

As has been described above, according to the apparatus for feeding a material to be stitched in a sewing machine of the present invention, the frame body can be maintained in a state where it is guided by the X-direction driven body and by the Y-direction driven body, even when the frame body is moved to an extremity of the moving range. Thus, the frame body can receive drive forces from the X-direction driven body and from the Y-direction driven body no matter where it is positioned, and the frame body can be driven without undergoing strain to feed the material to be stitched held by the frame body accurately irrespective of the position of the frame body. Therefore, the present invention exhibits a useful effect of applying embroidery to the material to be stitched accurately according to embroidery data.

What is claimed is:

1. An apparatus for feeding material to be stitched to desired positions within an X-Y rectangular coordinate plane on a sewing machine table, the apparatus comprising:

a plurality of Y-direction drive mechanisms arranged parallelwise at predetermined intervals under the machine table;

a plurality of X-direction drive mechanisms also arranged parallelwise at predetermined intervals under the machine table;

a Y-direction driven body that is elongated in the X-direction and connected to the Y-direction drive mechanism to be driven on the machine table in the Y-direction only;

an X-direction driven body that is elongated in the Y-direction and connected to the X-direction drive mechanisms to be driven on the machine table in the Y-direction only; and a frame body for releasably holding the material to be stitched, which is connected to Y-direction driven body to be movable in the X-direction relative to the Y-direction driven body and is connected to the X-direction driven body to be movable in the Y-direction relative to the X-direction driven body;

wherein the plurality of X-direction drive mechanisms are designed to be disposed between a first Y-direction drive mechanism located at an outermost position among the plurality of Y-direction drive mechanisms and a second Y-direction drive mechanism located adjacent to said first Y-direction drive mechanism.

2. An apparatus for feeding material to be stitched to desired positions within an X-Y rectangular coordinate plane on a sewing machine table the apparatus comprising:

a plurality of Y-direction drive mechanisms arranged parallelwise at predetermined intervals;

a plurality of X-direction drive mechanisms also arranged parallelwise at predetermined intervals;

a Y-direction driven body connected to the Y-direction drive mechanism to be driven on the machine table in the Y-direction only;

an X-direction driven body connected to the X-direction drive mechanism to be driven on the machine table in the X-direction only; and a frame body for releasably holding the material to be stitched, which is connected to be movable in the X-direction relative to the Y-direction driven body and in the Y-direction relative to the X-direction driven body;

wherein the plurality of X-direction drive mechanisms are designed to be disposed between a Y-direction drive mechanism located at an outermost position among the plurality of Y-direction drive mechanisms and a second Y-direction drive mechanism located adjacent to said first Y-direction drive mechanism; and wherein the X-direction drive mechanism and the Y-direction drive mechanism each consist essentially of timing pulleys axially supported through brackets at both ends of an open-top frame having a U-shaped cross section, respectively, a timing belt extended across these timing pulleys.

3. An apparatus for feeding material to be stitched to desired positions within an X-Y rectangular coordinate plane on a sewing machine table, the apparatus comprising:

a plurality of Y-direction drive mechanisms arranged parallelwise at predetermined intervals;

a plurality of X-direction drive mechanisms also arranged parallelwise at predetermined intervals;

a Y-direction driven body connected to the Y-direction drive mechanism to be driven on the machine table in the Y-direction only;

an X-direction driven body connected to the X-direction drive mechanism to be driven on the machine table in the X-direction only; and a frame body for releasably holding the material to be stitched, which is connected to be movable in the X-direction relative to the Y-direction driven body and in the Y-direction relative to the X-direction driven body;

wherein the plurality of X-direction drive mechanisms are designed to be disposed between a first Y-direction drive mechanism located at an outermost position among the plurality of Y-direction drive mechanisms and a second Y-direction drive mechanism located adjacent to said first Y-direction drive mechanism; and wherein an opposing pair of pulley shafts attached to the Y-direction drive mechanism, respectively, are connected to each other through a connecting shaft of a Y-axis drive motor, which is driven in the normal direction or in the reverse direction to drive the pair of Y-direction drive mechanisms commonly through the connecting shaft and, in turn, the timing belts to run in the same direction.

4. The apparatus for feeding a material to be stitched according to claim 1, 2 or 3, wherein drive sources for the X-direction drive mechanisms and the Y-direction drive mechanisms are linear motors.

* * * * *